US010151165B2

(12) United States Patent
Evans

(10) Patent No.: US 10,151,165 B2
(45) Date of Patent: Dec. 11, 2018

(54) ADJUSTABLE HYDRAULIC JARRING DEVICE

(71) Applicant: Robert W. Evans, Conroe, TX (US)

(72) Inventor: Robert W. Evans, Conroe, TX (US)

( * ) Notice: Subject to any disclaimer, the term of this patent is extended or adjusted under 35 U.S.C. 154(b) by 230 days.

(21) Appl. No.: 15/054,394

(22) Filed: Feb. 26, 2016

(65) Prior Publication Data

US 2017/0247968 A1 Aug. 31, 2017

(51) Int. Cl.
*E21B 31/113* (2006.01)
*E21B 34/08* (2006.01)

(52) U.S. Cl.
CPC ..... *E21B 31/113* (2013.01); *E21B 34/08* (2013.01)

(58) Field of Classification Search
CPC ..... E21B 31/113; E21B 31/1135
USPC ..... 166/178, 237
See application file for complete search history.

(56) References Cited

U.S. PATENT DOCUMENTS 4,919,219 A * 4/1990 Taylor ..... E21B 23/006 166/178
6,988,551 B2 1/2006 Evans
7,290,604 B2 * 11/2007 Evans ..... E21B 31/107 166/178
7,510,008 B2 * 3/2009 Evans ..... E21B 31/1135 166/178
9,428,980 B2 * 8/2016 Evans ..... E21B 31/107

* cited by examiner

*Primary Examiner* — Kenneth L Thompson
(74) *Attorney, Agent, or Firm* — Tumey L.L.P.

(57) ABSTRACT

A jarring tool includes a spring and a hydraulic piston cylinder arrangement for controlling the release of a mandrel to initiate a jarring force. The tool includes an adjustment mechanism for adjusting the minimum amount of an upward pulling force required to release the mandrel. The adjustment mechanism includes an axially adjustable trigger sleeve that cooperates with a dog clutch surrounding the mandrel.

4 Claims, 4 Drawing Sheets

ADJUSTABLE HYDRAULIC JARRING DEVICE

CROSS-REFERENCE TO RELATED APPLICATIONS

Background of the Invention

Field of the Invention

This invention is directed to a jarring device typically used in conjunction with the drilling or operation of an oil/gas well. A jarring device is used to impart a force to a tubular string within a well when the string has become lodged in the well during well drilling or treating to free the tubular string from its captive state.

Discussion of Prior Art

Jarring tools commonly referred to as jars are known in the oil/gas well industry as a means to free tubulars from being lodged in the well during drilling or well treating operations. An upward or downward jarring force is applied by the jar to the tubular string thereby freeing it. Mechanical, hydraulic, and hybrid mechanical-hydraulic jars have been used. Hydraulic jars have an advantage over mechanical jars because the jarring load can be easily adjusted down hole simply by varying the pull from the surface. The trigger means usually incorporates a piston area to hydraulically resist the pull from the surface long enough for the desired load to be applied and a valve means to allow the jar to trigger after a defined travel and time delay has occurred. One of the disadvantages of a hydraulic jar is the jar will inadvertently trigger when running the pipe in the well due to the weight hanging below the jar. For this reason jars are ordinarily triggered at the surface by allowing the weight below the jar to cause the jar to fall open before running any additional pipe in the well. A safer method is to incorporate a lock means in the jar that will not release the jar to trigger until a preset lock load is pulled. Since bottom hole assemblies vary and the weight hanging below the jar will vary, it is desirable to have a lock means that can be adjusted at the location prior to running in the hole.

Consequently there is a need for an adjustable mechanical-hydraulic jarring device that can be easily adjusted to accommodate varying conditions.

BRIEF SUMMARY OF THE INVENTION

A jarring device according to an embodiment of the invention includes a spring, a floating hydraulic piston, a dog clutch coupled to a mandrel and a trigger sleeve adapted to be adjustably positioned within the jar so that the amount of force required to release the mandrel and thus initiate the jarring action is variable.

BRIEF DESCRIPTION OF THE DRAWINGS

For a detailed description of the preferred embodiments of the invention, reference will now be made to the accompanying drawings in which.

DETAILED DESCRIPTION OF AN EMBODIMENTS OF THE INVENTION

Figure 1:
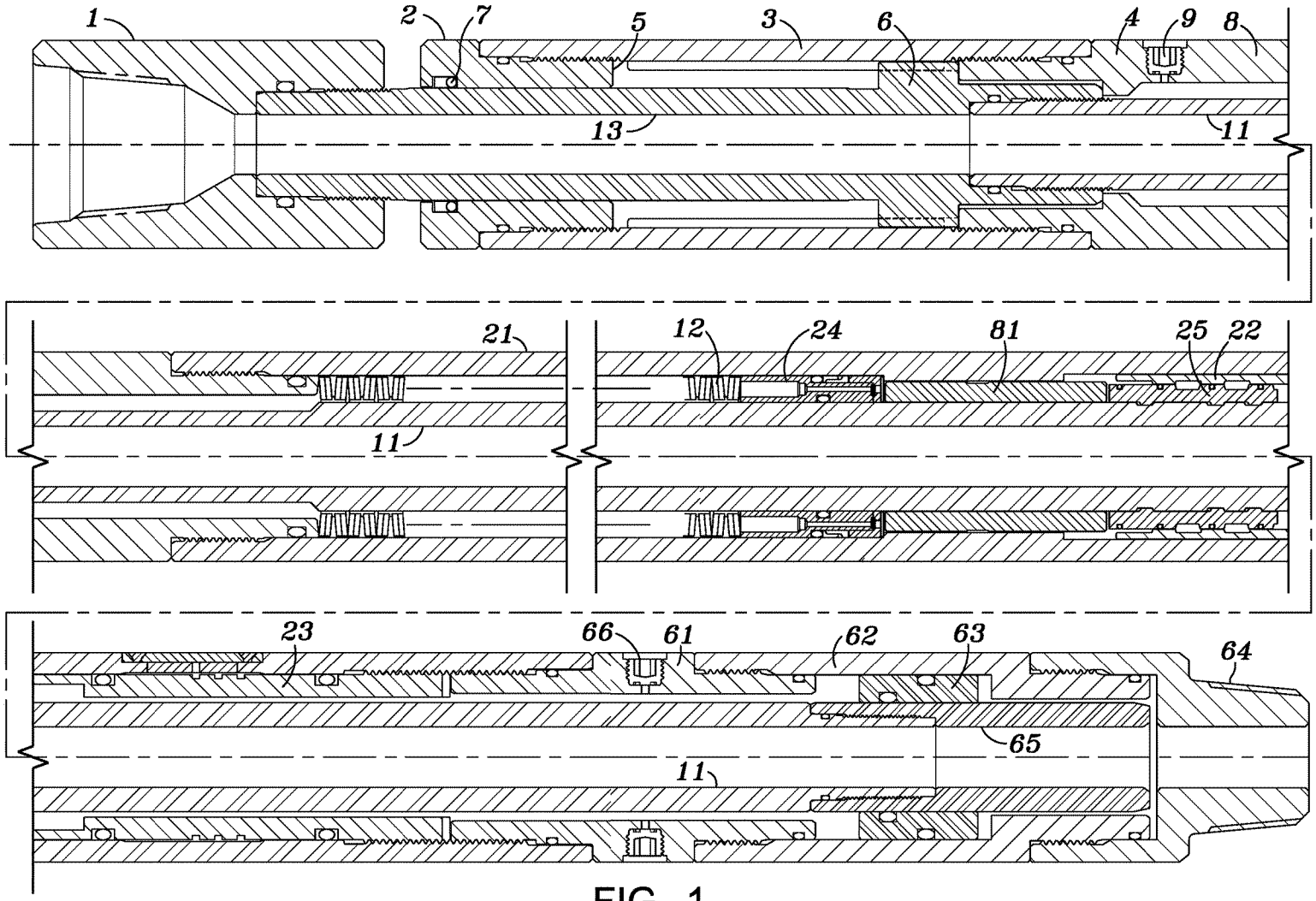
FIG. 1 is a cross sectional view of an embodiment of the invention.

Referring to FIG. 1, an embodiment of the invention includes a centrally located mandrel having an uphole portion 13 secured to a connector 1 which is adapted to be connected to a tubular string or the like. Portion 13 includes an enlarged section 6 which acts as a hammer against anvil 5 located on a closure member 2 of the outer housing in a known manner.

The mandrel includes a middle portion 11 which is connected to a downhole portion 65. The mandrel once released is axially movable in the housing.

The jar housing includes the closure member 2 which is connected to an uphole housing portion 3 which in turn to is connected to a sub 8 which includes a lubricant fitting 9. Sub 8 is connected to a middle portion 21 of the housing which in turn is connected to a second sub 61 which includes a lubricating fitting 66. Sub 61 is connected to a downhole portion 62 which in turn is connected to a coupling 64 which is adapted to be connected to a lower portion of a tubular string. A balancing piston 63 is located within housing portion 62. A seal 7 is positioned between mandrel 13 and closure member 7.

Figure 2:
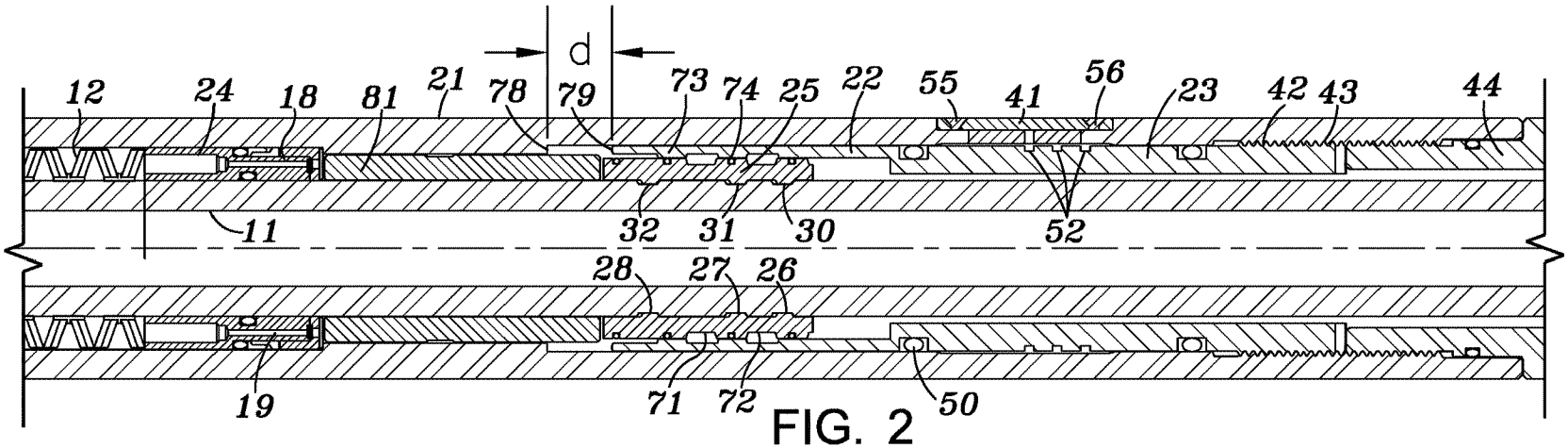
FIG. 2 is a cross-sectional view of the mid portion of the jar including the trigger sleeve, dog clutch and the adjustment sleeve.
Figure 3:
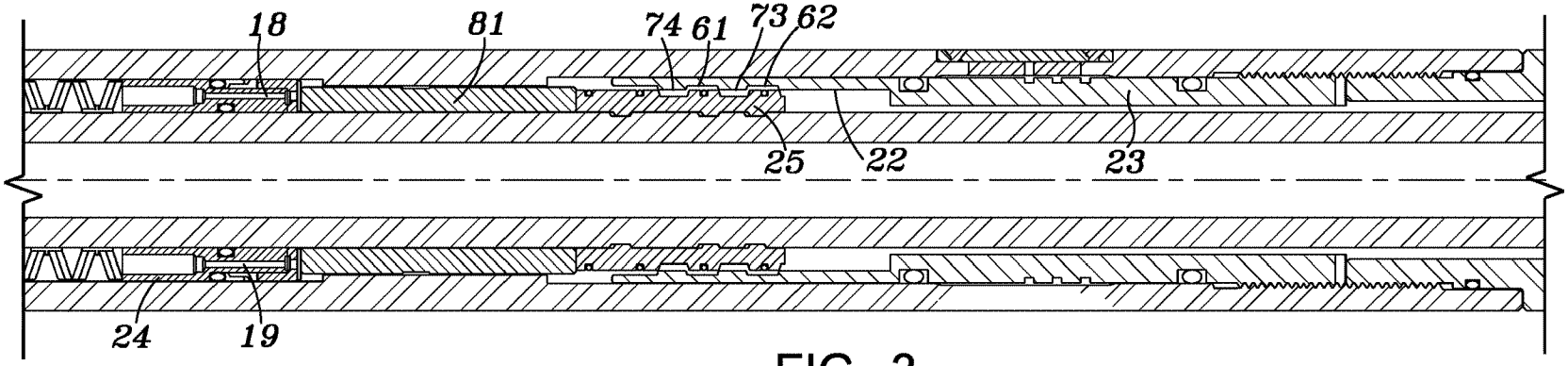
FIG. 3 is a cross-sectional view of the mid portion of the jar in a minimum lock adjustment just prior to release of the mandrel.

Middle portion 11 of the mandrel is surrounding by a dog clutch 25 and a trigger sleeve 22 as shown in FIGS. 1 and 2. Mandrel portion 11 is provided with a plurality of axially spaced grooves 26, 27, 28 which may be spaced apart from each other by different distances.

Dog clutch 25 is annular in shape and surrounds mandrel middle portion 11.

Dog clutch 25 may be of the type disclosed in U.S. patent application Ser. No. 14/621,577 filed Feb. 13, 2015, the entire contents of which is hereby incorporated herein by reference thereto.

Dog clutch 25 may have a plurality of segments each of which has annular tabs 30, 31, and 32 which are adapted to fit within grooves 26, 27, 28 of the mandrel 11 in a locking position as described in the above identified patent application.

The outer surface of the segments of the dog clutch has axially spaced grooves 71, 72 that are adapted to receive tabs 73 and 74 on the inner surface of the trigger sleeve 22 when the dog clutch is in the release position.

Figure 4:
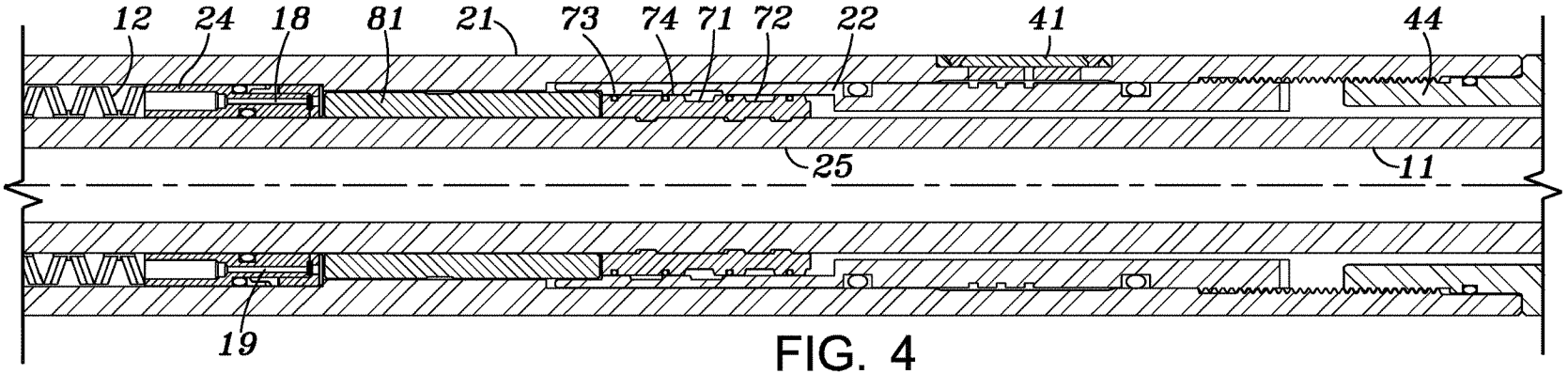
FIG. 4 is a cross-sectional view of the mid portion of the jar with the adjustment sleeve set for maximum lock.

The axial position of trigger sleeve 22 and thus the distanced d between a stop shoulder 78 formed on the inner surface of middle housing portion 21 and end face 79 of the trigger sleeve 22 as shown in FIG. 2 may be varied by removing a cover plate 41 from the housing 21 and inserting a tool into one of the slots 52. A lower portion of trigger sleeve 22 is threadably attached at 42, 43 to middle portion 21 of the housing. Thus by applying a rotational force to the trigger sleeve via a tool inserted into one of the slots 52, trigger sleeve 22 will be rotated and axially moved due to threads 42, 43 thereby adjusting the distance between shoulder 78 and end face 79 as shown in FIG. 4.

In operation, an upward force on the mandrel will cause the mandrel to move in an upward direction. Movement of the mandrel will be resisted by a bellville spring assembly 12 and by hydraulic fluid in the tool which must pass through a cylindrical piston 24 which includes one or more restricted orifices 19 and one or more check valves 18. Annular piston 24 surrounds middle mandrel portion 11. An annular spacer sleeve 81 is positioned between piston 24 and dog clutch 25.

Mandrel portion 11 will be held by dog clutch 25 until such time as the tabs 73, 74 of the trigger sleeve come into registry with grooves 71, 72 of the dog clutch. At this point tabs 30, 31, and 32 of the dog clutch will be forced out of grooves 26, 27, and 28 in the mandrel middle portion by the upward force on the mandrel. This will release the mandrel from the dog clutch 25 whereupon the mandrel hammer surface 6 will strike anvil 5 on the housing. The movement of the mandrels from the closed position to the release position is resisted by the force of the springs 12 and by the hydraulic pressure generated by the piston 24 compressing the fluid in the hydraulic chamber as the mandrel is pulled upward. As the load is initially applied from the surface it is resisted by the pressure generated in the hydraulic chamber due to the area between the piston 24 OD and the OD of mandrel 13 at seal 7. As fluid leaves the hydraulic chamber by flowing through the orifice 19 in the piston 24 the mandrels move upward slowly and some of the load is transferred to the springs 12. It should be appreciated that if the load is not strong enough to compress the springs 12 far enough to cause the dog clutch 25 to come into registration with the trigger sleeve 22 the jar will not release. Therefore, if the spring force is stronger than the weight of the tools hanging below the jar it will not release.

The release load can be varied by moving the trigger sleeve in an uphole direction. This will cause tabs 73 and 74 to move uphole and thus increasing the distance that the dog clutch needs to travel before grooves 71 and 72 of the dog clutch register with the tabs 73, 74 of the trigger sleeve as shown in FIG. 4. This additional movement will increase the force required to release the jar. This allows the release load to be adjusted to a minimum load higher than the weight below the jar. It should be further appreciated that the lock load is the MINIMUM release load of the jar. Because of the resistance of the pressure in the hydraulic chamber, the release load can be any load desired up to the structural limits of the housings or mandrels of the jar. In a normal jarring cycle the desired load would be applied to the jar from the surface by the draw works and the brake would be set. This would cause the pressure in the jar to increase to balance the applied load. The fluid in the hydraulic chamber would flow through the orifice in the piston and the mandrel would move upward in response until the dog clutch comes into registration with the trigger sleeve and the jar releases.

Figure 5:
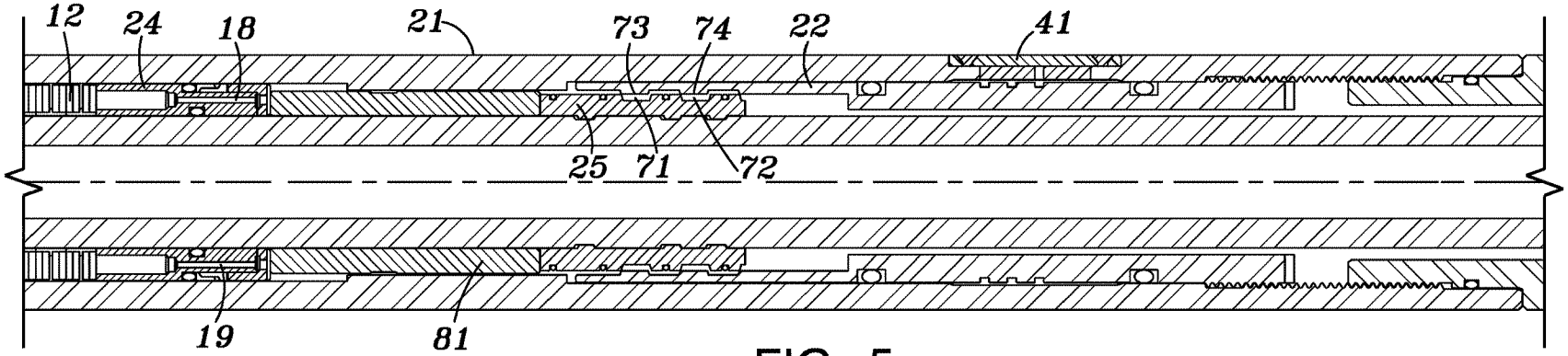
FIG. 5 is a cross sectional view of the jar as shown in FIG. 4 just prior to the release of the mandrel.

FIG. 5 illustrates the portion of the various components just prior to release of the mandrel.

The adjustable force mechanism discussed also could be used in combination with the trigger sleeve spring arrangement disclosed in U.S. patent application Ser. No. 14/621,577, filed Feb. 13, 2015, referenced above.

Figure 6:
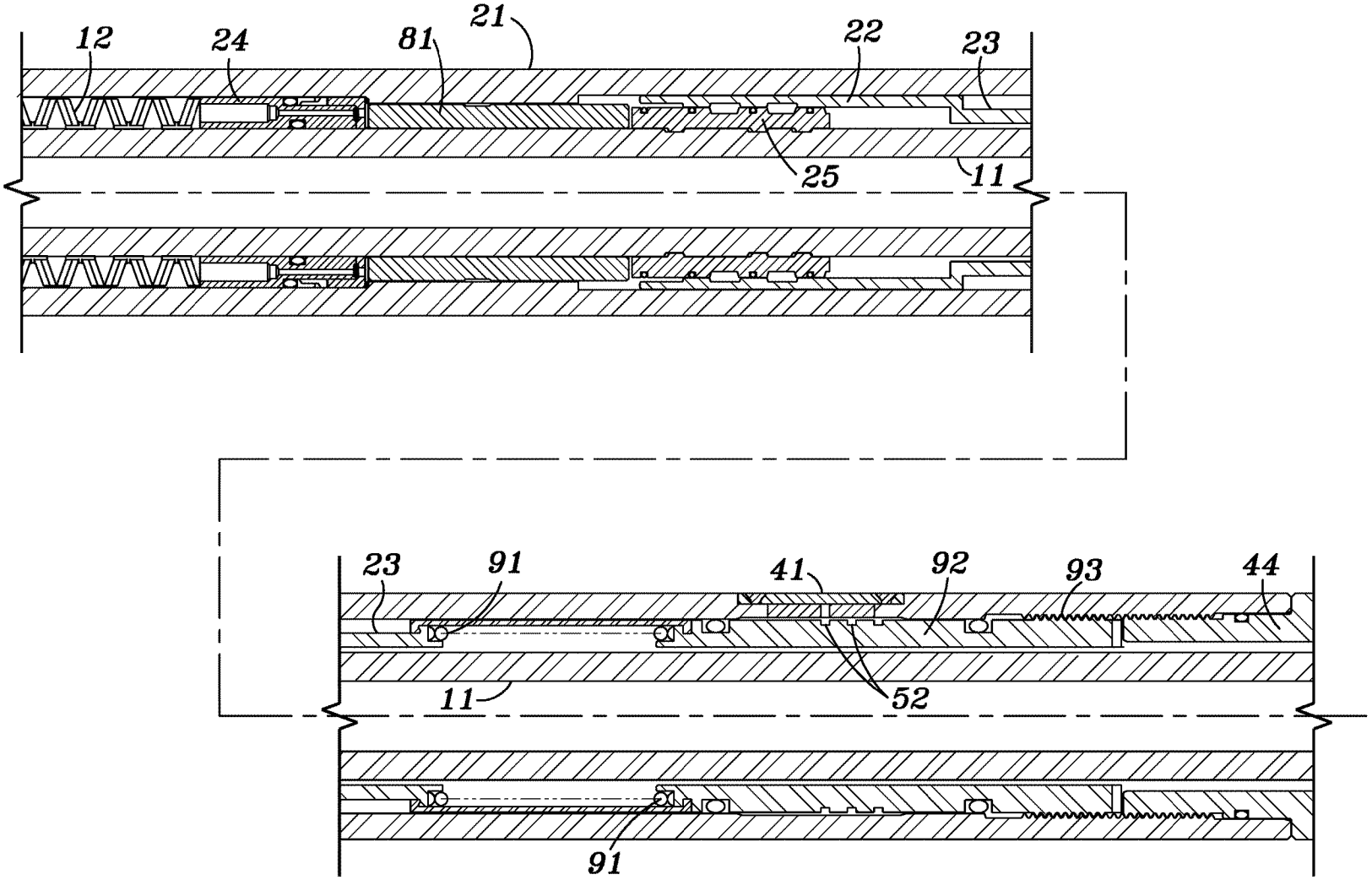
FIG. 6 is a cross sectional view of a second embodiment of the adjustable release mechanism.

As shown in FIG. 6, this last mentioned embodiment would include an additional member 92 as part of the trigger sleeve. A spring is positioned between trigger sleeve portion 23 and additional member 92.

Adjustment of the axial position of the trigger sleeve including portions 23 and 92 would be in the same manner as the trigger sleeve of FIG. 1 by a tool inserted in groove 52 after removing cover plate 41.

What is claimed is:

1. A jarring tool for releasing equipment lodged in a well comprising:

a) a housing;

b) an axially movable mandrel positioned within the housing;

c) a dog clutch surrounding the mandrel;

d) a trigger sleeve surrounding the dog clutch;

e) the dog clutch and trigger sleeve having complementary surfaces which when in alignment will cause the dog clutch to release the mandrel;

f) means for adjusting the axial position of the trigger sleeve with respect to the dog clutch via rotation of the trigger sleeve;

g) a spring positioned within the housing to resist the travel of the mandrel within the housing; and h) a hydraulic chamber and a piston located in the hydraulic chamber and surrounding the mandrel and, the piston being positioned between the spring and dog clutch.

2. The jarring tool of claim 1 wherein the piston includes at least one restricted flow path and at least one check valve whereby axial movement of the piston in an upward direction is impeded by the restricted flow path.

3. The jarring tool of claim 1 wherein the trigger sleeve includes an annular portion having axially spaced annular tabs and the dog clutch has a plurality of axially spaced grooves so that the annular tabs on the trigger sleeve are positioned within the axially spaced grooves when the mandrel is released from the dog clutch.

4. A jarring tool for releasing equipment lodged in a well comprising:

a) a housing;

b) an axially movable mandrel positioned within the housing;

c) a release member between the mandrel and the housing;

d) a trigger sleeve surrounding the release member;

e) the release member and the trigger sleeve having complementary surfaces which when in alignment will cause the release member to release the mandrel;

f) means for adjusting the axial position of the trigger sleeve with respect to the release member via rotation of the trigger sleeve;

g) a spring positioned within the housing to resist the travel of the mandrel within the housing; and h) a hydraulic chamber and a piston located in the hydraulic chamber and surrounding the mandrel and, the piston being positioned between the spring and the release member.

* * * * *